US007256747B2

(12) United States Patent
Victorian et al.

(10) Patent No.: US 7,256,747 B2
(45) Date of Patent: Aug. 14, 2007

(54) METHOD AND APPARATUS FOR A WIRELESS HEARING AID ANTENNA

(75) Inventors: Thomas A. Victorian, Plymouth, MN (US); James Newton, Burnsville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 10/768,735

(22) Filed: Jan. 30, 2004

(65) Prior Publication Data

US 2005/0168396 A1 Aug. 4, 2005

(51) Int. Cl.
*H01Q 1/12* (2006.01)
*H04R 25/00* (2006.01)

(52) U.S. Cl. ..... 343/718; 343/788; 381/322; 381/328

(58) Field of Classification Search ..... 381/314, 381/315, 320, 322, 328, 330, 324; 343/702, 343/787, 788
See application file for complete search history.

(56) References Cited

U.S. PATENT DOCUMENTS 2,409,481 A 10/1946 Fordham
2,791,762 A * 5/1957 Berry ..... 340/562
3,742,359 A * 6/1973 Behymer ..... 381/315
4,957,478 A * 9/1990 Maniglia ..... 600/25
5,015,224 A 5/1991 Maniglia
5,295,191 A 3/1994 Van Vroenhoven
5,420,930 A 5/1995 Shugart, III
5,627,521 A * 5/1997 Olsen et al. ..... 340/600
5,717,771 A 2/1998 Sauer et al.
5,721,783 A 2/1998 Anderson
5,842,115 A 11/1998 Dent
6,473,512 B1 10/2002 Juneau et al.
6,549,633 B1 4/2003 Westermann
6,648,813 B2 11/2003 Zilberman et al.
6,816,600 B1 * 11/2004 Jakob et al. ..... 381/315
2001/0041602 A1 11/2001 Berger et al.
2001/0053871 A1 12/2001 Zilberman et al.
2002/0091337 A1 7/2002 Adams et al.
2002/0191806 A1 * 12/2002 Rohrseitz et al. ..... 381/323
2003/0086583 A1 5/2003 Maltan et al.
2004/0204168 A1 * 10/2004 Laurila ..... 455/569.1

OTHER PUBLICATIONS

"Hearing Aids", http://www.asha.org/public/hearing/treatment/hearing_aids.htm, (Observed Jan. 22, 2004),6 pgs.

* cited by examiner

*Primary Examiner*—Tho Phan
(74) *Attorney, Agent, or Firm*—Schwegman, Lundberg, Woessner & Kluth, P.A.

(57) ABSTRACT

One aspect relates to a hearing aid having a housing with a face plate to which a handle is connected. Additionally, an at least partially coiled antenna is located proximal to the face plate. Another aspect relates to an apparatus comprised of a means for locating hearing aid components in a housing, a means for inserting and removing the hearing aid with a handle, a means for connecting the handle to the housing, and a means for integrating an antenna with the handle, wherein the antenna is located proximal to the housing. Another aspect relates to a method of making a hearing aid, including connecting an antenna to a handle and connecting the handle to the hearing aid, wherein the antenna is located proximate to the hearing aid housing.

42 Claims, 7 Drawing Sheets

METHOD AND APPARATUS FOR A WIRELESS HEARING AID ANTENNA

TECHNICAL FIELD

This application relates generally to hearing aids using antenna for wireless communication, and more particularly, to hearing aids including antenna proximal to a handle.

BACKGROUND

One goal of hearing aids is to replicate natural hearing. To achieve this goal, hearing aids must satisfy multiple requirements. One requirement is that hearing aids be comfortable and discreet. Another requirement is that they improve hearing. Any external addition to a hearing aid can be aesthetically undesirable, physically restrictive, uncomfortable, or result in other unwanted characteristics. Any internal additions to hearing aids can reduce the amount of space available to other components, such as computers, used to improve hearing.

In order to improve hearing, some hearing aids communicate and react with other devices. However, communication can require an antenna, which may increase size of the hearing aid. An antenna which protrudes from outside the hearing aid can be aesthetically unappealing and can receive increased electromagnetic interference.

Thus, there is a need for a wireless hearing aid having a space-efficient antenna configuration which provides adequate communications, does not reduce aesthetic appeal, comfort, or other performance requirements, and does not increase electromagnetic interference.

SUMMARY

The above-mentioned problems and others not expressly discussed herein are addressed by the present subject matter and will be understood by reading and studying this specification.

Completely in the canal hearing aids, canal hearing aids, and in the ear hearing aids, in various embodiments, use a feature known as a insertion removal handle, removal cord, or pull cord. The hearing aid user can use the handle to assist in removing or inserting the device. In some embodiments, the handle is used to both remove and insert a hearing aid. The present subject matter includes an antenna designed in combination with a handle.

Some hearing aids communicate with other devices, such as programmers, using wireless connections. The present subject matter includes an antenna to communicate wirelessly.

The various embodiments described herein relate to a handle with an integrated antenna. One benefit of the present subject matter is that it reduces stress passed to the antenna. Additionally, the present subject matter satisfies various aesthetic requirements. A further benefit of the present subject matter is that the location of the antenna in relation to the location of other components within the hearing aid can result in reduced electromagnetic interference, which can allow for a reduction in electromagnetic shielding. The present subject matter includes other benefits and solutions in addition to those enumerated above.

One aspect of the present subject matter relates to a hearing aid having a housing with a face plate to which a handle is connected. Additionally, an at least partially coiled antenna is located proximal to the face plate, and electronics are connected to the antenna.

A further aspect relates to an apparatus comprised of a means for locating hearing aid components in a housing, and a means for manipulating a hearing aid with a handle. Further, the apparatus is comprised of a means for connecting the handle to the housing, and a means for integrating an antenna with the handle, wherein the antenna is located proximal to the housing, and is connected to electronics.

A further aspect relates to a method of making a hearing aid, including connecting an antenna to a handle, and connecting the handle to the hearing aid, wherein the antenna is located proximate to the hearing aid housing.

This Summary is an overview of some of the teachings of the present application and is not intended to be an exclusive or exhaustive treatment of the present subject matter. Further details about the present subject matter are found in the detailed description and appended claims. Other aspects will be apparent to persons skilled in the art upon reading and understanding the following detailed description and viewing the drawings that form a part thereof, each of which are not to be taken in a limiting sense. The scope of the present invention is defined by the appended claims and their equivalents.

BRIEF DESCRIPTION OF THE DRAWINGS

Various embodiments are illustrated by way of example and not by way of limitation in the figures of the accompanying drawings in which like references indicate similar elements.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. Other embodiments may be utilized and structural, logical, and electrical changes may be made without departing from the scope of the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Various aspects and embodiments of the present subject matter include components to a hearing aid. The present subject matter includes connecting a wireless antenna proximal to a handle of a hearing aid. The present subject matter also includes connecting the handle proximal to the hearing aid housing. Additionally, the present subject matter includes connecting the handle and the hearing aid housing such that the antenna is proximal to the hearing aid housing.

One benefit of the present subject matter is that it reduces electromagnetic interference by allowing the antenna to be mounted in an improved proximity to other components within the hearing aid. A further benefit of the present subject matter is that it is space-efficient. An additional benefit of the present subject matter is that the antenna does not protrude from the hearing aid in an unaesthetic fashion. The benefits offered by the present subject matter are not limited to those enumerated here.

Figure 1:
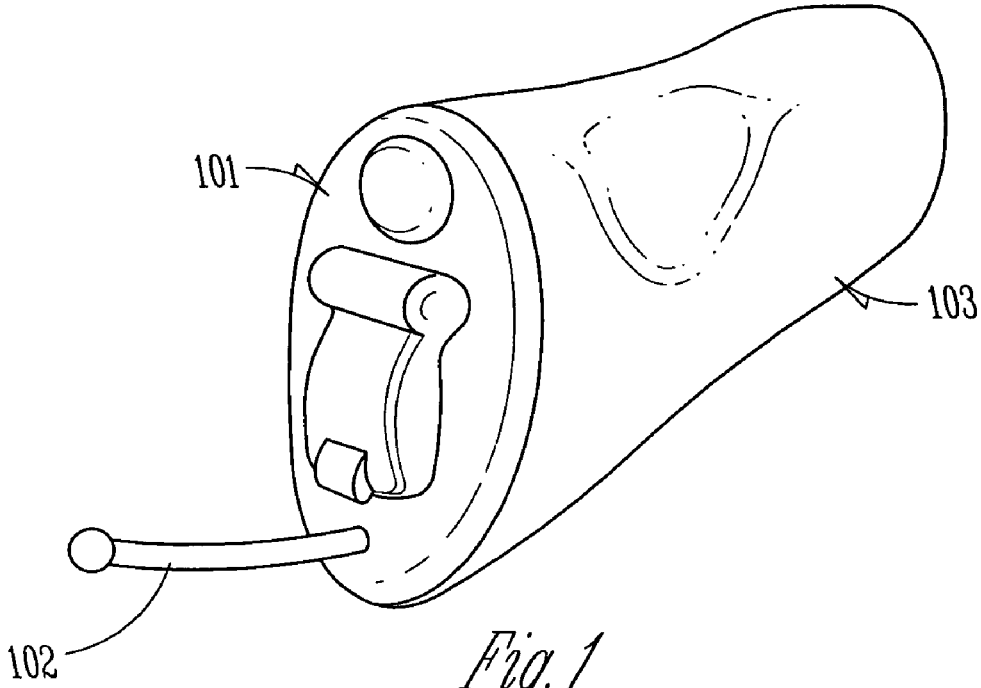
FIG. 1 illustrates one embodiment of a hearing aid which can employ an antenna according to one embodiment of the present subject matter.

FIG. 1 illustrates one embodiment of a hearing aid. In various embodiments, the hearing aid fits into the ear at least partially. Once inserted, hearing aids can be difficult to manipulate without a handle 102. The handle 102 sticks out of the ear and allows the user to grasp it and manipulate the hearing aid.

In various embodiments, the handle 102 is fastened to the face plate 101. Various embodiments include a face plate 101 formed of a stiff polymeric material. In various embodiments, the face plate forms at least part of the exterior envelope of the hearing aid. In various embodiments, the face plate 101 is a standard shape, and the shell 103 is molded to fit an individual ear canal. Various embodiments are contemplated by the present subject matter. For example, other embodiments include a shell 103 and face plate 101 molded in concert to fit an individual ear canal. Other embodiments not enumerated herein are possible without departing from the scope of the present subject matter.

Figure 2A:
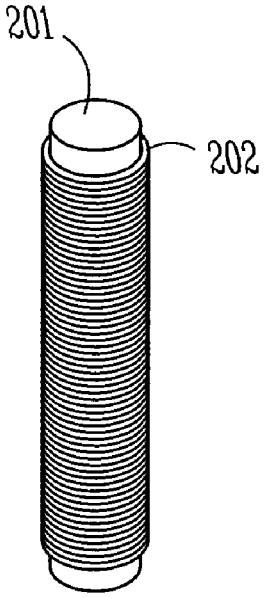
FIG. 2A illustrates one embodiment of a wireless rod antenna for use in hearing aids according to one embodiment of the present subject matter.

FIG. 2A illustrates one embodiment of a wireless rod antenna for use in hearing aids according to one embodiment of the present subject matter. In various embodiments, the rod antenna comprises a solid ferrite core 201 around which conductor 202 is wrapped. However, the present subject matter is not limited to such component materials or geometries. One embodiment includes a hollow core. Further embodiments include a core composed of a non-ferrous material. These and other embodiments are within the scope of the present subject matter.

Various embodiments include a core 201 which ranges between approximately 2 mm and 6 mm long, and ranges between approximately 0.5 mm and 2 mm in diameter. One embodiment includes a solid ferrite core which is approximately 4 mm long and approximately 1 mm in diameter. However, the present subject matter is not limited to such component materials or geometries; various embodiments include a hollow core, and further embodiments are made from non-ferrous materials.

In various embodiments the core 201 is wrapped with conductor multiple times. Various embodiments include a configuration which is wrapped with conductor between approximately 40 and approximately 120 turns. One embodiment includes a core which is wrapped approximately 90 turns. Further embodiments include a core which is wrapped with separate conductors, allowing a separate number of wrappings for transmitting and receiving.

Figure 2B:
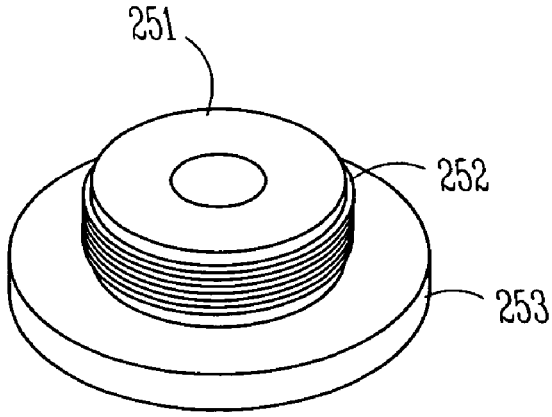
FIG. 2B illustrates one embodiment of a wireless ring antenna for use in hearing aids according to one embodiment of the present subject matter.

FIG. 2B illustrates one embodiment of a wireless ring antenna for use in hearing aids according to one embodiment of the present subject matter. In various embodiments, the conductor 252 is wrapped around a ring shaped ferrite core 251, such that the center axis formed by the loops of conductor is collinear with the center axis of the ring. However, the present subject matter is not limited to such component materials or geometries; in one embodiment, the core is solid, i.e., disk shaped, and in further embodiments, the core is made from non-ferrous materials. These and other embodiments are within the scope of the present subject matter.

Various embodiments include a ring shape comprised of various length-wise segments of different diameters. In one example, the shape includes a smaller diameter segment 251 around which the conductor is wrapped, and a larger diameter segment 253, around which conductor is not wrapped. In various embodiments, the conductor wrapped segment ranges between approximately 1 mm and approximately 5 mm in length, and between approximately 2 mm and approximately 3 mm in diameter. In one embodiment, the conductor wrapped segment is approximately 2.5 mm long, and approximately 3 mm in diameter.

Various embodiments include a configuration which is wrapped with conductor between approximately 50 and approximately 70 times. In one embodiment, the core is wrapped approximately 60 times by conductor. Further embodiments include a core which is wrapped with separate conductors, allowing a separate number of wrappings for transmitting and receiving.

In various embodiments, the choice between a ring antenna embodiment and a rod antenna embodiment will depend on various performance characteristics. In various ring embodiments, the ring shape allows the handle to be placed through the center portion of the antenna. In various embodiments, this allows portions of the antenna to reside within recesses of the housing, while allowing the handle to function as part of an adjustment system. In various embodiments, positioning the antenna in a recess in the housing can increase space within the hearing aid. Increased space within the hearing aid can allow improvements in other components, such as computers or batteries.

Various embodiments of the rod antenna demonstrate increased robustness in the polar pattern of the antenna. An increased robustness in an antenna polar pattern can decrease the sensitivity between antenna orientation and antenna function, allowing for a greater range of functional antenna orientations. In various embodiments, improved robustness of the polar pattern is due to an improved aspect ratio. An improved aspect ratio can result in improved performance overall. Additionally, various embodiments of the rod antenna are less expensive to manufacture than ring embodiments. The scope of the present subject matter includes all of these benefits, but is not to be understood as limited to those benefits enumerated here.

Figure 3A:
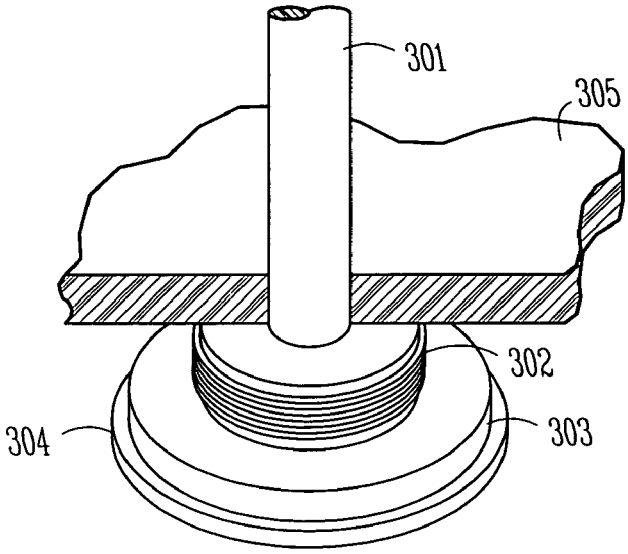
FIG. 3A illustrates an isometric cut-away view of one embodiment of a ring shaped antenna connected to a handle for a hearing aid in accordance with the present subject matter.

FIG. 3A illustrates an isometric cut-away view of one embodiment of a ring shaped antenna connected to a handle for a hearing aid in accordance with the present subject matter. In various embodiments, the portion of the antenna wrapped with conductor 302 is located between the face plate 305 and the antenna flange 303. In further embodiments, the antenna is located between the handle flange 304 and the face plate 305. In addition to embodiments in which the handle 301 serves as a useful device for removing and inserting a hearing aid, in various embodiments, the handle is part of an adjustment system. In one embodiment, the handle 301 can be rotated to adjust volume. Further embodiments adjust frequency response, compression, and any other adjustable variable useful to control hearing aid function. These adjustments, in various embodiments, are achieved by interacting with other system components, e.g. a potentiometer.

Figure 3B:
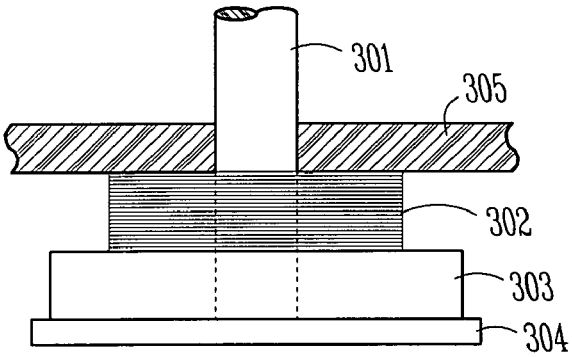
FIG. 3B illustrates a side cut-away view of an embodiment of a ring shaped antenna connected to a handle for a hearing aid in accordance with the present subject matter, such that the conductor is located between the face-plate and an antenna flange.

FIG. 3B illustrates a side cut-away view of an embodiment of a ring shaped antenna connected to a handle for a hearing aid in accordance with the present subject matter, such that the conductor is located between the face-plate and an antenna flange. In various embodiments, the smaller diameter segment 302 is mounted proximal to the face plate 305, and the larger diameter segment 303 is located distal to the face plate 305. Additionally, in various embodiments, the larger diameter segment 303 is mounted proximal to a larger diameter segment 304 of the handle 301. The larger diameter segment 304 of the handle 301, in various embodiments, sandwiches the antenna between itself 304 and the face plate 305.

Figure 3C:
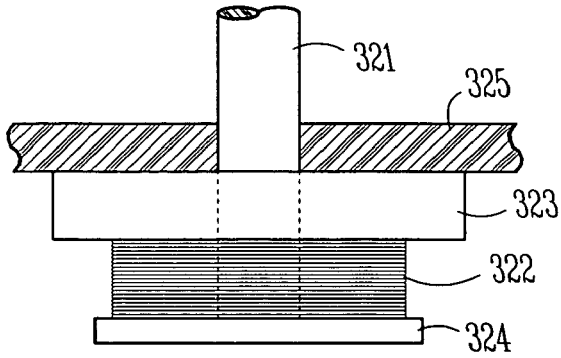
FIG. 3C illustrates a side cut-away view of an embodiment of a ring shaped antenna connected to a handle for a hearing aid in accordance with the present subject matter, such that the antenna flange is located between the face-plate and the conductor.

FIG. 3C illustrates a side cut-away view of an embodiment of a ring shaped antenna connected to a handle for a hearing aid in accordance with the present subject matter, such that the antenna flange 323 is located between the face-plate 325 and the conductor 322. In one embodiment, the smaller diameter segment 322 is mounted distal to the face plate 325, and the larger diameter segment 323 is located proximal to the face plate 325. Additionally, in various embodiments, the smaller diameter segment 322 is mounted proximal to a larger diameter segment of the handle 324. The larger diameter segment of the handle 324, in various embodiments, sandwiches the antenna between itself 324 and the face plate 325.

Figure 3D:
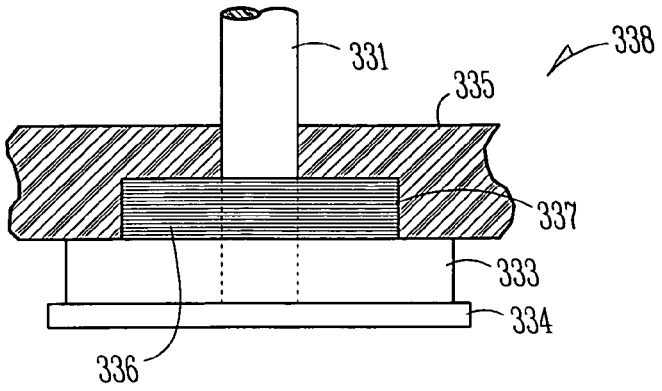
FIG. 3D illustrates a side cut-away view of an embodiment of a ring shaped antenna connected to a handle for a hearing aid in accordance with the present subject matter, such that the conductor is recessed in the face plate.

FIG. 3D illustrates a side cut-away view of an embodiment of a ring shaped antenna connected to a handle for a hearing aid in accordance with the present subject matter, such that the conductor is recessed in the face plate. In various embodiments, mounting all or portions of the antenna in a recess in the face plate can increase the space available in the interior of the hearing aid. Increased space can be used for improvements in computers or other components.

In one embodiment the smaller diameter segment 337 is mounted in a recess in the face plate 335, and the larger diameter segment 333 is located further away from the exterior of the hearing aid 338. In further embodiments, the smaller diameter segment 337 is located further from the exterior of the hearing aid 338 than the larger diameter segment 333.

In various embodiments, the larger segment 333 may also be at least partially located within a recess, or the smaller portion 337 may be only partially located within the recess. Additionally, in various embodiments, the larger diameter segment 333 is mounted proximal to a larger diameter segment of the handle 334. The larger diameter segment 333 of the handle 331, in various embodiments, sandwiches the antenna between itself 334 and the face plate 335.

The present subject matter, however, is not to be understood as limited to these geometries or component orientations. One embodiment includes an orientation in which the larger diameter segment 333 is recessed in the face plate 335, and the smaller diameter segment 337 is located proximate to the larger diameter segment 334 of the handle. Further embodiments include a range of recess depths in which the antenna is located.

Further embodiments also mount the antenna at an angle, such that the center axis of the antenna is separated from the center axis of the handle by a range of degrees when measured at their intersection. In other embodiments, the axes are skewed or parallel. These and other embodiments are within the scope of the present subject matter, and the present subject matter is not to be understood as limited to the embodiments enumerated here.

Figure 4A:
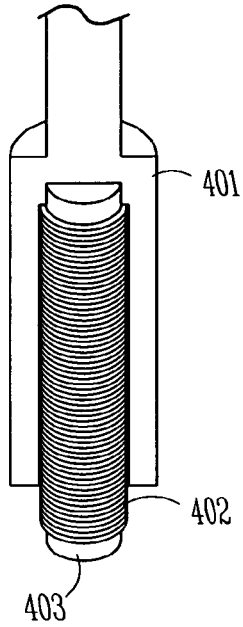
FIG. 4A illustrates an isometric cut-away view of one embodiment of a rod shaped antenna connected to a handle for a hearing aid in accordance with the present subject matter.

FIG. 4A illustrates an isometric cut-away view of one embodiment of a rod shaped antenna connected to a handle for a hearing aid in accordance with the present subject matter. The figure is cut away to show the detail of the solid core 403 and the conductor wrappings 402 mounted in a handle 401.

Figure 4B:
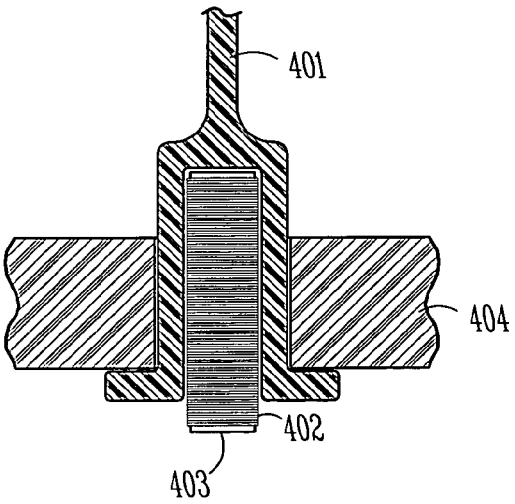
FIG. 4B illustrates a side view of one embodiment of a rod shaped antenna, showing the face plate and handle cut away, and showing the antenna connected to a handle for a hearing aid in accordance with the present subject matter.

FIG. 4B illustrates a side view of one embodiment of a rod shaped antenna, showing the face plate and handle cut away, and showing the antenna connected to a handle for a hearing aid in accordance with the present subject matter. FIG. 4B shows a cut away side view of a rod antenna mounted in the handle. Additionally, FIG. 4B illustrates a cut away view of the hearing aid face plate. In various embodiments, the rod antenna includes a solid core 403, around which conductor 402 is wrapped. In various embodiments, the rod antenna is longer than the cavity in the handle 401 into which it is received. In other embodiments, it is not. Various embodiments employ a variety of fits between the handle and the rod antenna, including interference, non-interference, or any combination thereof. In addition to the type of fit used, various embodiments can employ adhesive fastening, encapsulation, or various combinations of known fastening methods.

Additionally, the handle fits into a receiving channel in the face plate 404. Various embodiments employ a variety of fits between the handle and the face plate 404, including interference, non-interference, or any combination thereof. In addition to the type of fit used, various embodiments can employ adhesive fastening, or various combinations of known fastening methods.

Figure 4C:
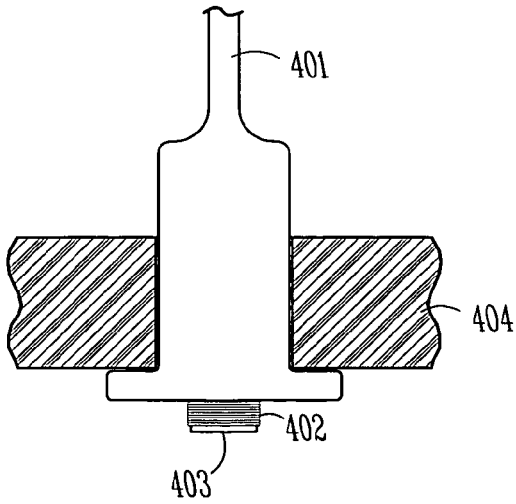
FIG. 4C illustrates a side view of one embodiment of a rod shaped antenna, showing the face plate cut away, and showing the antenna connected to a handle for a hearing aid in accordance with the present subject matter.

FIG. 4C illustrates an side view of one embodiment of a rod shaped antenna, showing the face plate cut away, and showing the antenna connected to a handle for a hearing aid in accordance with the present subject matter. In various embodiments, the rod antenna includes a solid core 403, around which conductor 402 is wrapped. This figure illustrates how the rod antenna can partially stick out from the receptacle in the handle 401. The figure further illustrates one embodiment of the handle connection to the face plate 404.

Figure 5:
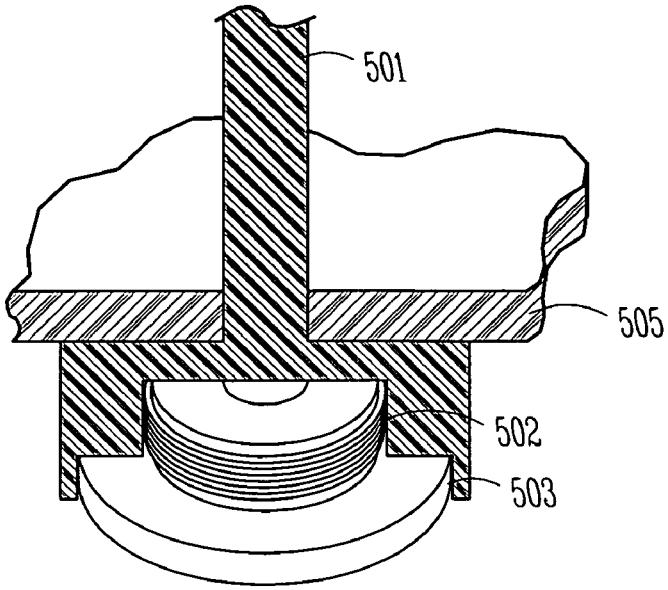
FIG. 5 illustrates one embodiment of a ring shaped antenna integrated inside a handle according to one embodiment of the present subject matter.

FIG. 5 illustrates one embodiment in which a ring shaped antenna is located inside a handle. In various embodiments, the ring antenna includes a core 503, around which conductor 502 is wrapped. In various embodiments, the ring antenna is longer than the cavity in the handle 501 into which it is received. In other embodiments, it is not. Various embodiments employ a variety of fits between the handle 501 and the ring antenna, including interference or non-interference, or any combination thereof. In addition to the type of fit used, various embodiments can employ adhesive fastening, encapsulation, or various combinations of known fastening methods.

FIG. 5 additionally illustrates that the handle fits into a receiving channel in the face plate. Various embodiments employ a variety of fits between the handle 501 and the face-plate 505, including interference or non-interference, or any combination thereof. In addition to the type of fit used, various embodiments can employ adhesive fastening, or various combinations of known fastening methods.

Figure 6:
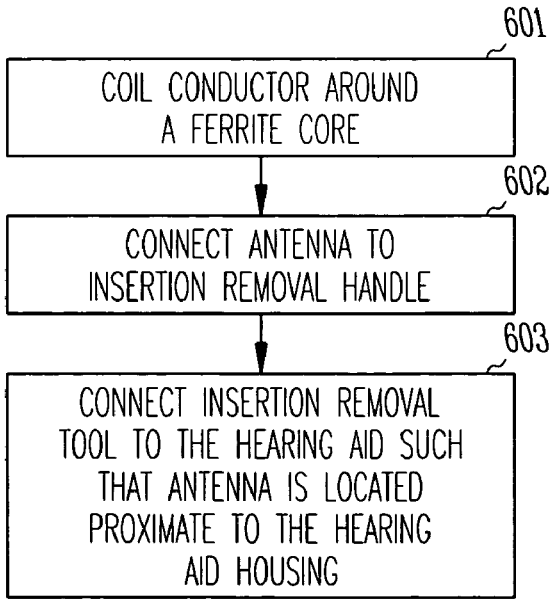
FIG. 6 illustrates a method for constructing a hearing aid including a handle, with an antenna integrated with the handle according to one embodiment of the present subject matter.

FIG. 6 illustrates a method for constructing a handle with an antenna integrated with the handle. In various embodiments, the method connects 602 the handle to the hearing aid face-plate. In further embodiments, the method coils 601 a conductor around a ferrite core. The method, in various embodiments, also includes connecting 603 the antenna to the handle. The method, in additional embodiments, connects the handle to the hearing aid housing. In further embodiments, the antenna is located proximal to the face plate.

Figure 7A:
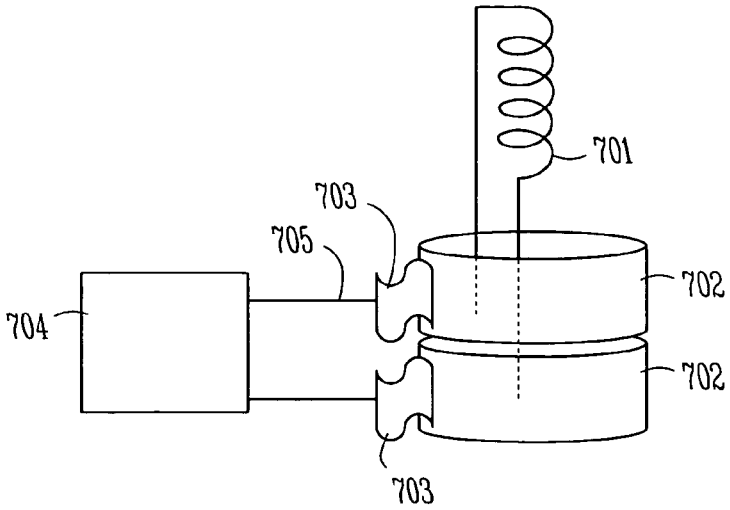
FIG. 7A illustrates one embodiment of a hearing aid which can facilitate rotary movement of the handle through commutation according to one embodiment of the present subject matter.

FIG. 7A illustrates one embodiment of a hearing aid which can facilitate rotary movement of the handle through commutation according to one embodiment of the present subject matter. In various embodiments, the antenna 701 experiences rotation as the handle is rotated to adjust a hearing aid parameter, such as signal gain. Various embodiments include brushes 703 which contact a commutator 702, allowing the commutator 702 to rotate independent of the brushes 703, while maintaining an ability to conduct electricity to components 704. In various embodiments, the result is an apparatus which can conduct electricity between the antenna 701 and the hearing aid components 704 while allowing the antenna 701 to rotate freely and without limit. One benefit of this embodiment is that it allows the antenna to rotate freely without putting excess physical stress on the conductors 705.

Figure 7B:
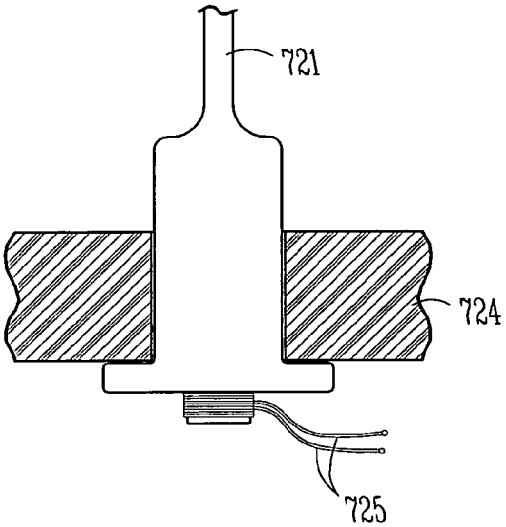
FIG. 7B illustrates one embodiment of a hearing aid which can facilitate axial movement of the handle through flexible conductors connecting the antenna to other components, according to one embodiment of the present subject matter.

FIG. 7B illustrates one embodiment of a hearing aid which can facilitate axial movement of the handle through flexible conductors connecting the antenna to other components, according to one embodiment of the present subject matter. In various embodiments, the conductor can include additional length 725, so that the antenna can move independent of other component to which the conductors are attached, without damaging the conductors. Various embodiments allow depression of the handle to allow selection of one or more hearing aid parameters, such as signal gain. In various embodiments, the axial movement of the handle is mechanically limited so that the user may not move the antenna beyond the range of motion permitted by the additional length 725. In various embodiments, the face plate 724 constrains the handle 721 during axial movement.

Figure 7C:
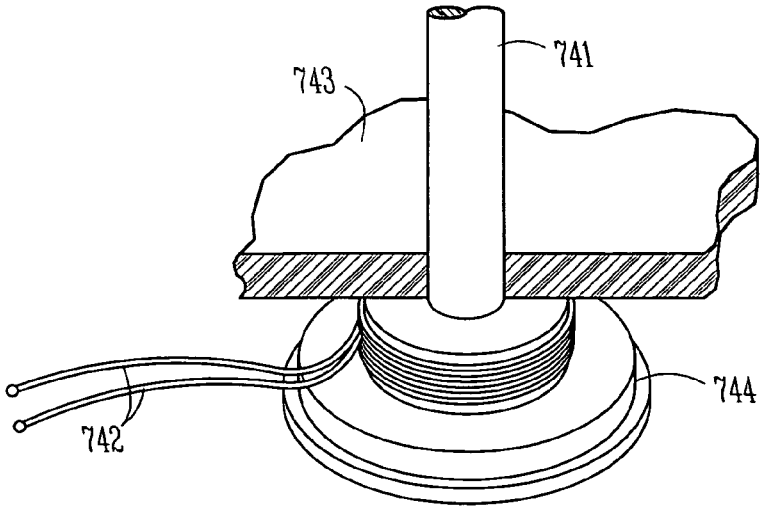
FIG. 7C illustrates one embodiment of a hearing aid which can facilitate rotary movement of the handle through flexible conductors connecting the antenna to other components, according to one embodiment of the present subject matter.

FIG. 7C illustrates one embodiment of a hearing aid which can facilitate rotary movement of the handle through flexible conductors connecting the antenna to other components, according to one embodiment of the present subject matter. In various embodiments, the conductor can include additional length 742, so that the antenna can move independent of the other component to which the conductors are attached, without damaging the conductors. In various embodiments, the full rotation of the handle 741 is mechanically limited so that the user may not rotate the antenna 744 beyond the range of motion permitted by the additional length 742. In various embodiments, the face plate 743 constrains the handle 741 during rotation, in others, it does not.

Figure 7D:
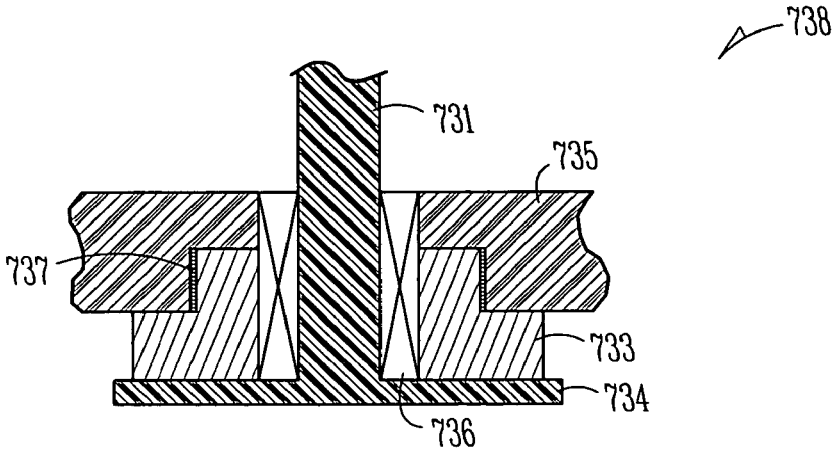
FIG. 7D illustrates one embodiment of a hearing aid which facilitates movement of the handle according to one embodiment of the present subject matter.

FIG. 7D illustrates one embodiment of a hearing aid which facilitates movement of the handle according to one embodiment of the present subject matter. In various embodiments, a bearing 736 is fixed to the face plate 735, and the antenna is fixed to the face plate 735. In additional embodiments, the antenna is fixed to the face plate 735, and the bearing 736 is fixed to the antenna. In some embodiments, the bearing may extend completely through the thickness of faceplate 735, and in others, it extends part of the way through. In further embodiments, the bearing may extend completely through the antenna, and in other embodiments, it extends part of the way through. In various embodiments, components which are fixed are mechanically joined using an interference fit. In other embodiments, they are joined using adhesives, or other joining methods. It should be noted that the scope of the present subject matter includes various bearings, plastic bushings, and other apparatus which facilitate movement of the handle 731. Additionally, the present subject matter includes embodiments which do not include a bearing, but include a friction reducing coating applied either to the handle 731, the passageway through which the handle 731 passes, or both.

Various embodiments allow limitless rotation of the handle 731, and other embodiments limit rotation. Further embodiments include axial movement, and still further embodiments involve axial movement exclusively. In various embodiments, the axial movement of the handle is limited mechanically.

In various embodiments, at least a portion of the antenna is located in a recess in the face-plate 735. Other embodiments do not include a recess. Additionally, in various embodiments, the ring shaped antenna may be configured so that either the larger diameter section 733 or the smaller diameter section 737 are nearest to the exterior of the hearing aid 738.

Figure 8:
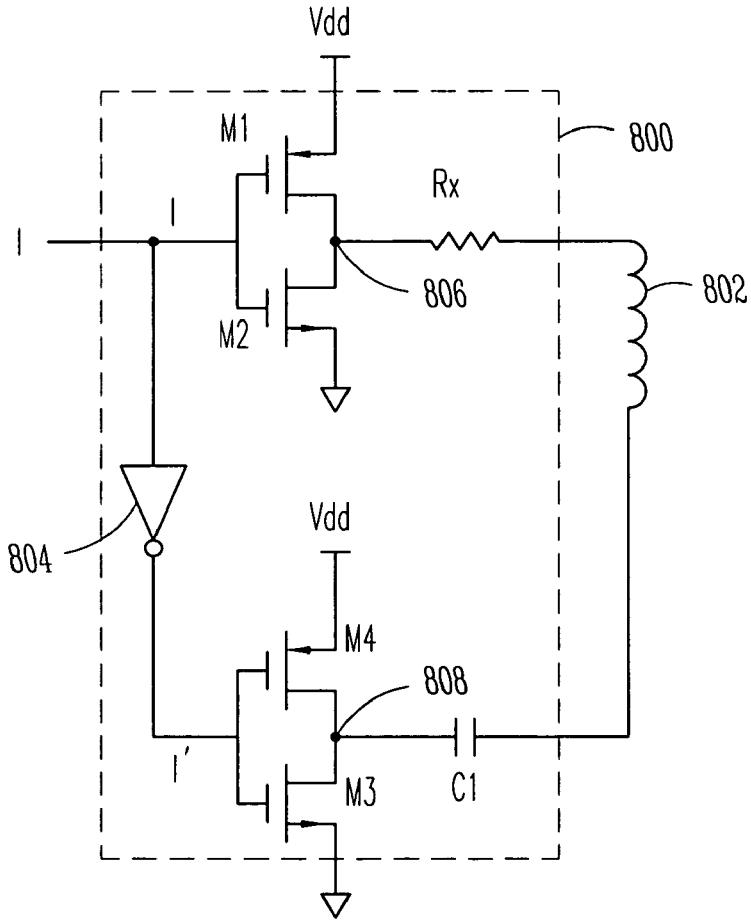
FIG. 8. Shows one example of a transmission circuit for use with the antenna of the present system, according to one embodiment of the present subject matter.

FIG. 8 shows one example of a transmission circuit 800 for use in combination with embodiments of the antenna 802 of the present system. In the example of FIG. 8, input signal, I is provided to the circuit and an oppositely phased signal, I', is produced by the inverter 804. It is noted that in this particular example, the information transmitted is digital and the switching electronics employ digital gates for inversion and switching in general. Other embodiments may employ nonstandard switching electronics with bipolar voltage supplies and other variations without departing from the scope of the present invention. In the example provided in FIG. 8, the modulation is amplitude shift keying. However, it is understood that other modulation techniques may be employed without departing from the scope of the present application. Such modulation techniques include, but are not limited to, phase shift keying, frequency shift keying, pulse amplitude modulation, frequency modulation, and amplitude modulation.

The I signal is provided to the gates of field effect transistors M1 and M2 and the I' signal is provided to the gates of field effect transistors M3 and M4, which are connected as shown in FIG. 8 In this example, the transistors drive antenna 802, which may be modeled as having an intrinsic resistance, R1 (not shown) and inductance, L1 (not shown), in series with capacitor C1. In one embodiment, the resulting circuit is a D-class amplifier in an H-bridge configuration to drive L1 and C1. Resistor Rx is used to set the Q of the circuit.

In operation, when the input signal, I, is a logic high, then transistor M1 is not conducting and transistor M2 is conducting, which forces the output voltage at output 806 a logic low. I' is a logic low when I is logic high. Consequently, when I' is a logic low, then M3 is not conducting and M4 is conducting, which forces the output voltage at output 808 to a logic high.

It is noted that field effect transistors also provide a form of overvoltage protection, since they serve as diodes in the reverse-conduction direction which clamp the output signals 806 and 808 between the applied voltage rails (in this example, Vdd and ground).

It is noted that the polarities of the supplies, use of logic low and logic high states, and voltage levels may be changed without departing from the scope of the present subject matter. Also, other types of transistors and configurations may be employed without departing from the scope of the present application. In one embodiment, bipolar junction transistors are used to provide switching. Other switching structures may be utilized without departing from the scope of the present teachings.

In such embodiments, it is possible to use, for instance, a communications signal having approximately an 80 meter wavelength to communicate with a wire antenna 802 that may have a length of approximately 1 meter. Such communications may be conducted with primarily inductive coupling (primarily the H field) at low power levels. In one embodiment, a level of less than 1 milliwatt may suffice for short range communications with the antenna 802. In such embodiments, a distance of 20 to 50 centimeters may be used for communications between the transmitter and receiver. Other wavelengths and power levels may be employed and other distances may be used without departing from the scope of the present subject matter.

One advantage of the short range nature of the communications is that other electronics will operate without radio frequency interference and other hearing devices may be programmed in proximity and even at the same time without interference.

Figure 9:
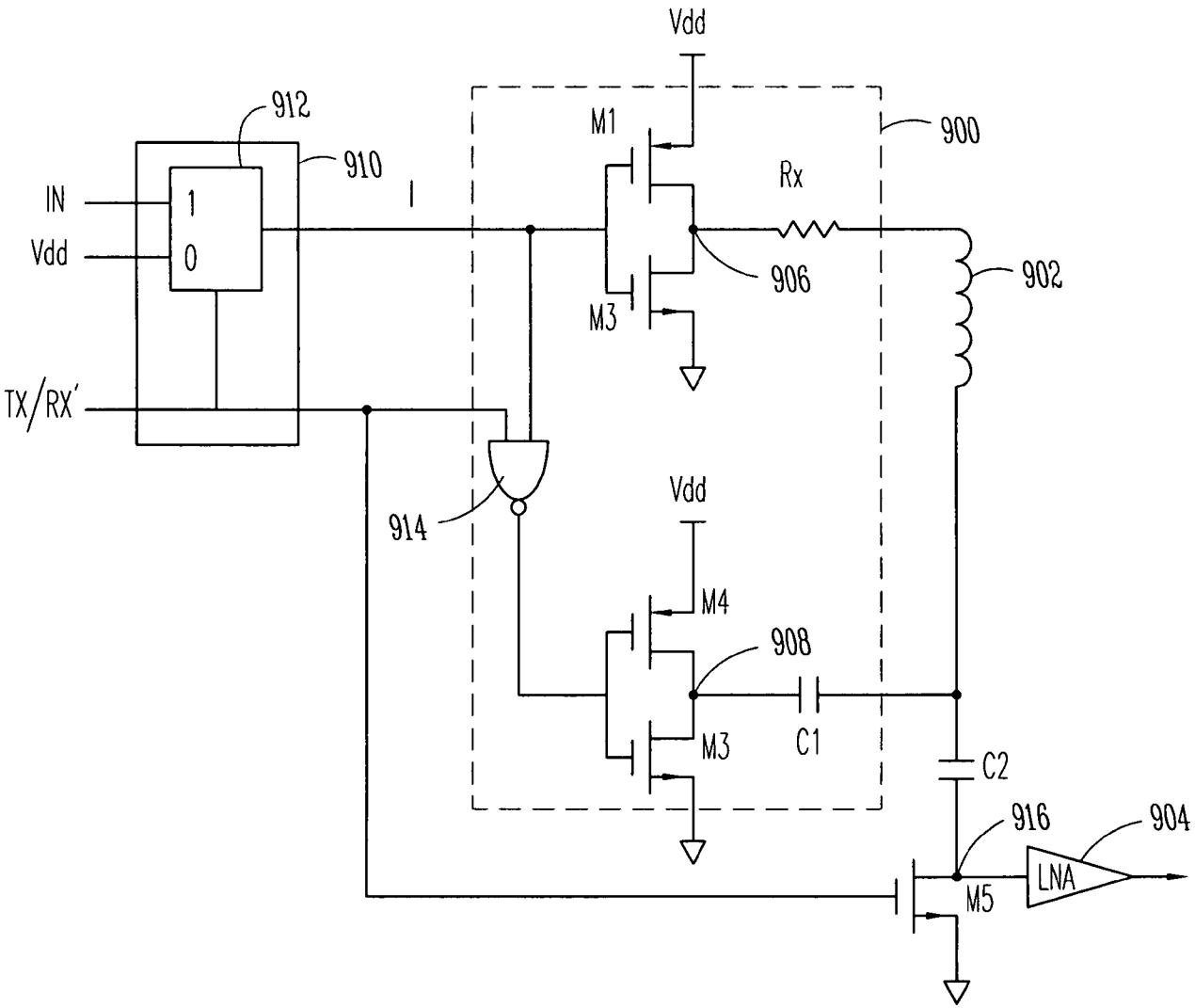
FIG. 9. illustrates one example of a circuit capable of both transmission and reception for use with the antenna of the present system, according to one embodiment of the present subject matter.

In another embodiment, a system is shown where a receiver and transmitter are connected to an antenna 902 for transmission and reception. FIG. 9 shows a transmitting and receiving circuit 900 with a receiving amplifier 904 and additional circuitry 910 for controlling the communications for both transmission and reception.

In the example of FIG. 9, a transmit mode and a receive mode are switched by changing the TX/RX' input. In this example embodiment, transmit mode is identified by a logic high signal into the TX/RX' input. With TX/RX' at a logic high value, the switching circuit 910 includes a switch 912 which routes the input signal, IN, to the input of the transmitting circuit 900, I. The logic high value of the TX/RX' signal also causes NAND gate 914 to act as an inverter of the I signal. This permits transmitter circuit 900 to operate much like transmitter 800 in FIG. 8 during transmission mode. The input of low noise amplifier 904, which is denoted as node 916, is at a logic low value, since transistor MS is conducting when its gate is at a logic high for transmit mode. Thus, the low noise amplifier 904 is not receiving signals from antenna 902 during transmission.

In transmission mode, the I signal is provided to the gates of field effect transistors M1 and M2 and the I' signal is provided to the gates of field effect transistors M3 and M4, which are connected as shown. NAND gate 914 inverts the I signal while TX/RX' is logic high (in the transmit mode). In this example, the transistors M1, M2, M3, and M4 drive antenna 902, which may be modeled as having an intrinsic resistance, R1 (not shown) and inductance, L1 (not shown), in series with capacitor C1. In one embodiment, the resulting circuit is a D-class amplifier in an H-bridge configuration to drive L1 and C1. Resistor Rx is used to set the Q of the circuit.

In operation, when the input signal, I, is a logic high, then transistor M1 is not conducting and transistor M2 is conducting, which forces the output voltage at output 906 a logic low. I' is a logic low when I is logic high. Consequently, when I' is a logic low, then M3 is not conducting and M4 is conducting, which forces the output voltage at output 908 to a logic high.

It is noted that field effect transistors also provide a form of overvoltage protection, since they serve as diodes in the reverse-conduction direction which clamp the output signals 906 and 908 between the applied voltage rails (in this example, Vdd and ground).

It is noted that the polarities of the supplies, use of logic low and logic high states, and voltage levels may be changed without departing from the scope of the present subject matter. Also, other types of transistors and configurations may be employed without departing from the scope of the present application. In one embodiment, bipolar junction transistors are used to provide switching. Other switching structures may be utilized without departing from the scope of the present teachings.

When the TX/RX' line is logic low, the device is in receive mode. In receive mode, the output of the NAND gate will always be at a logic high, since the TX/RX' line is at a logic low. The switching circuit 910 includes a switch 912 which switches I to Vdd (logic high) during receive mode. This places outputs 906 and 908 at logic low levels and provides reception by amplifier 904 via capacitor C2, as the TX/RX' signal is logic low and M5 is nonconducting. In this embodiment, the antenna 902 and capacitor C1 form a parallel resonant tank receiver circuit for small signals received by antenna 902.

Other variations are possible which provide receive mode and transmit mode using the antenna 902 and without departing from the teachings of the present subject matter.

Upon reading and understanding the present subject matter, one skilled in the art will appreciate that various hardware, connections, and combinations of components may be employed to accomplish the present subject matter. For instance, the transmission and reception modes may be performed using different hardware and different logic level signals. For example, the switching circuit 910, in various embodiments, may use an embedded microprocessor, microcontroller and may be embodied in various combinations of hardware and software.

One of ordinary skill in the art will understand that, the systems shown and described herein can be implemented using software, hardware, and combinations of software and hardware. As such, the term "system" is intended to encompass software implementations, hardware implementations, and software and hardware implementations.

Although specific embodiments have been illustrated and described herein, it will be appreciated by those of ordinary skill in the art that any arrangement which is calculated to achieve the same purpose can be substituted for the specific embodiment shown. This application is intended to cover adaptations or variations of the present subject matter. It is to be understood that the above description is intended to be illustrative, and not restrictive. Combinations of the above embodiments, and other embodiments will be apparent to those of skill in the art upon reviewing the above description. The scope of the present subject matter should be determined with reference to the appended claims, along with the full scope of equivalents to which such claims are entitled.

What is claimed is:

1. An apparatus for an ear, comprising:
a hearing aid housing having a face plate;
the hearing aid housing adapted to contain a hearing aid transmission circuit and adapted to fit in the ear;
a handle connected to the housing; and
an antenna located proximal to the face plate and connected to the hearing aid transmission circuit, wherein the antenna is at least partially coiled,
wherein the housing is adapted to be a completely in the canal hearing aid.

2. The apparatus of claim 1, wherein flexible wire connects the antenna to other components and is adapted to allow antenna movement relative to the other components.

3. The apparatus of claim 1, wherein a commutator and brushes connect the antenna and other components and the commutator and brushes allow antenna movement relative to the other components.

4. The apparatus of claim 1, wherein the antenna is approximately 1 meter long.

5. The apparatus of claim 1, wherein the hearing aid transmission circuit includes a reception circuit.

6. The apparatus of claim 5, wherein the handle extends through at least one coil of the antenna.

7. The apparatus of claim 5, wherein at least one coil of the antenna extends into the handle.

8. The apparatus of claim 7, wherein the antenna is wrapped around a rod.

9. The apparatus of claim 8, wherein the number of conductor wrappings is between about 40 to about 120 turns.

10. The apparatus of claim 8, wherein the axial length of the antenna is from about 1 millimeter to about 6 millimeters, with a diameter from about 0.5 millimeters to about 2 millimeters.

11. An apparatus for an ear, comprising:
a hearing aid housing having a face plate;
the hearing aid housing adapted to contain a hearing aid transmission circuit and adapted to fit in the ear;
a handle connected to the housing; and
an antenna located proximal to the face plate and connected to the hearing aid transmission circuit, wherein the antenna is at least partially coiled,
wherein the housing is adapted to be an in the canal hearing aid.

12. The apparatus of claim 3, wherein at least one coil of the antenna extends into the handle.

13. The apparatus of claim 12, wherein the antenna is wrapped around a rod.

14. The apparatus of claim 13, wherein the number of conductor wrappings is between about 40 to about 120 turns.

15. The apparatus of claim 13, wherein the axial length of the antenna is from about 1 millimeter to about 6 millimeters, with a diameter from about 0.5 millimeters to about 2 millimeters.

16. The apparatus of claim 11, wherein the handle extends through at least one coil of the antenna.

17. The apparatus of claim 16, wherein the at least one coil is wrapped around a ring shape.

18. The apparatus of claim 17, wherein the number of conductor turns is from about 50 turns to about 70 turns.

19. The apparatus of 17, wherein one portion of the ring shape forms the wrapped antenna, and is from about 1 millimeter to 5 millimeters in length, and from about 2 millimeters to 3 millimeters in diameter.

20. An apparatus for an ear, comprising:
a hearing aid housing having a face plate;
the hearing aid housing adapted to contain a hearing aid transmission circuit and adapted to fit in the ear;
a handle connected to the housing; and
an antenna located proximal to the face plate and connected to the hearing aid transmission circuit, wherein the antenna is at least partially coiled,
wherein at least one coil of the antenna extends into the handle.

21. The apparatus of claim 20, wherein the antenna is wrapped around a rod.

22. The apparatus of claim 21, wherein the handle moves independent of the housing.

23. The apparatus of claim 21, wherein the rod includes ferrite.

24. The apparatus of claim 21, wherein the number of conductor wrappings is between about 40 to about 120 turns.

25. The apparatus of claim 24, wherein the number of conductor wrappings is approximately 90 turns.

26. The apparatus of claim 21, wherein the axial length of the antenna is from about 1 millimeter to about 6 millimeters, with a diameter from about 0.5 millimeters to about 2 millimeters.

27. The apparatus of claim 26, wherein the axial length of the antenna is approximately 4 millimeters, and the diameter is approximately 1 millimeter.

28. An apparatus for an ear, comprising:
a hearing aid housing having a face plate;
the hearing aid housing adapted to contain a hearing aid transmission circuit and adapted to fit in the ear;
a handle connected to the housing; and
an antenna located proximal to the face plate and connected to the hearing aid transmission circuit, wherein the antenna is at least partially coiled, wherein the handle extends through at least one coil of the antenna.

29. The apparatus of claim 28, wherein at least one coil of the antenna extends into the handle.

30. The apparatus of claim 28, wherein the at least one coil is wrapped around a ring shape.

31. The apparatus of claim 30, wherein the ring shape is ferrite.

32. The apparatus of 30, wherein one portion of the ring shape forms the wrapped antenna, and is from about 1 millimeter to 5 millimeters in length, and from about 2 millimeters to 3 millimeters in diameter.

33. The apparatus of 32, wherein the length is approximately 2.5 millimeters, and the diameter is approximately 3 millimeters.

34. The apparatus of claim 30, wherein the number of conductor turns is from about 50 turns to about 70 turns.

35. The apparatus of claim 34, wherein the number of conductor turns is approximately 60.

36. The apparatus of claim 30, wherein the antenna is fixed in a face plate; and the handle moves relative to the antenna.

37. The apparatus of claim 28, wherein the hearing aid housing is adapted to be a completely in the canal hearing aid.

38. The apparatus of claim 37, wherein the at least one coil is wrapped around a ring shape.

39. The apparatus of claim 38, wherein the number of conductor turns is from about 50 turns to about 70 turns.

40. The apparatus of 38, wherein one portion of the ring shape forms the wrapped antenna, and is from about 1 millimeter to 5 millimeters in length, and from about 2 millimeters to 3 millimeters in diameter.

41. An apparatus, comprising:

a housing having a face plate;

the housing adapted to contain hearing aid electronics;

a handle connected to the housing;

an antenna located proximal to the face plate and connected to the hearing aid electronics;

wherein the antenna has a ferrite core, the antenna core is rod shaped, the antenna core is wrapped with a conductor approximately 90 times, and the antenna core is approximately 4 millimeters long and approximately 1 millimeters in diameter; and wherein the antenna is at least partially inserted in the handle.

42. An apparatus, comprising:

a housing having a face plate;

the housing adapted to contain hearing aid electronics;

a handle connected to the housing;

an antenna located proximal to the face plate and connected to the hearing aid electronics, wherein the antenna has a ferrite core, the antenna core is ring shaped, the antenna core is wrapped approximately 60 times, and the wrapped portion of the antenna core is approximately 2.5 millimeters long and 3 millimeters in diameter; and wherein the handle is at least partially inserted through the antenna.

* * * * *

UNITED STATES PATENT AND TRADEMARK OFFICE

CERTIFICATE OF CORRECTION

PATENT NO. : 7,256,747 B2
APPLICATION NO. : 10/768735
DATED : August 14, 2007
INVENTOR(S) : Victorian et al.

It is certified that error appears in the above-identified patent and that said Letters Patent is hereby corrected as shown below:

In column 3, line 27, delete “Shows” and insert -- shows --, therefor.

In column 8, line 10, delete “component” and insert -- components --, therefor.

In column 10, line 20, delete “MS” and insert -- M5 --, therefor.

Signed and Sealed this

Sixth Day of May, 2008

JON W. DUDAS
*Director of the United States Patent and Trademark Office*